US008474295B2

(12) United States Patent
Schmid et al.

(10) Patent No.: US 8,474,295 B2
(45) Date of Patent: Jul. 2, 2013

(54) METHOD OF COMPACTING THE SURFACE OF A SINTERED PART

(75) Inventors: Herbert Schmid, Vorchdorf (AT); Karl Dickinger, Vorchdorf (AT); Wolfgang Siessl, Traunkirchen (AT)

(73) Assignee: Miba Sinter Austria GmbH (AT)

( * ) Notice: Subject to any disclaimer, the term of this patent is extended or adjusted under 35 U.S.C. 154(b) by 760 days.

(21) Appl. No.: 12/310,772

(22) PCT Filed: Aug. 31, 2007

(86) PCT No.: PCT/AT2007/000416

§ 371 (c)(1),
(2), (4) Date: Nov. 4, 2009

(87) PCT Pub. No.: WO2008/028207

PCT Pub. Date: Mar. 13, 2008

(65) Prior Publication Data

US 2011/0132057 A1 Jun. 9, 2011

(30) Foreign Application Priority Data

Sep. 4, 2006 (AT) ..... A 1468/2006

(51) Int. Cl.
*B21K 1/30* (2006.01)
*B21D 45/02* (2006.01)

(52) U.S. Cl.
USPC ..... 72/343; 72/355.6; 72/359; 72/467; 29/893.3; 29/893.34

(58) Field of Classification Search
USPC ..... 72/272, 253.1, 343, 355.6, 359, 467; 29/893.3, 893.34
See application file for complete search history.

(56) References Cited

U.S. PATENT DOCUMENTS 2,306,263 A 12/1942 Gutbrod et al.
2,957,232 A 10/1960 Bartlett (Continued)

FOREIGN PATENT DOCUMENTS

EP 1201338 5/2002
GB 2275054 8/1994

(Continued)

OTHER PUBLICATIONS

International Search Report, PCT/AT2007/000416.

*Primary Examiner* — David B Jones
(74) *Attorney, Agent, or Firm* — Lerner, David, Littenberg, Krumholz & Mentlik, LLP

(57) ABSTRACT

The invention describes a method of compacting the surface of a sintered part (2), whereby a sintered part (2) is moved in a die (1) along an axis (3) in a pressing direction (20) through several die portions (7, 8, 9) from a first die portion (7) at a first die orifice (6) into a last die portion (9), and a wall surface (16) of each die portion (7, 8, 9) forms at least one pressing surface (18) against which a contact surface (17) formed by an external surface (12) of the sintered part (2) is pressed, and an internal contour (25) defined by the pressing surface (18) lying in a cross-section by reference to the axis (3) at least approximately corresponds to an external contour (26) defined by the contact surface (17). As the sintered part (2) is moved, the surface is compacted from the first die orifice (6) to the last die portion (9) by die portions (7, 8, 9) continuously merging into one another and by monotonously decreasing internal diameters (19) of the die portions (7, 8, 9) as measured between co-operating pressing surfaces (18).

34 Claims, 4 Drawing Sheets

U.S. PATENT DOCUMENTS

Figure 1:
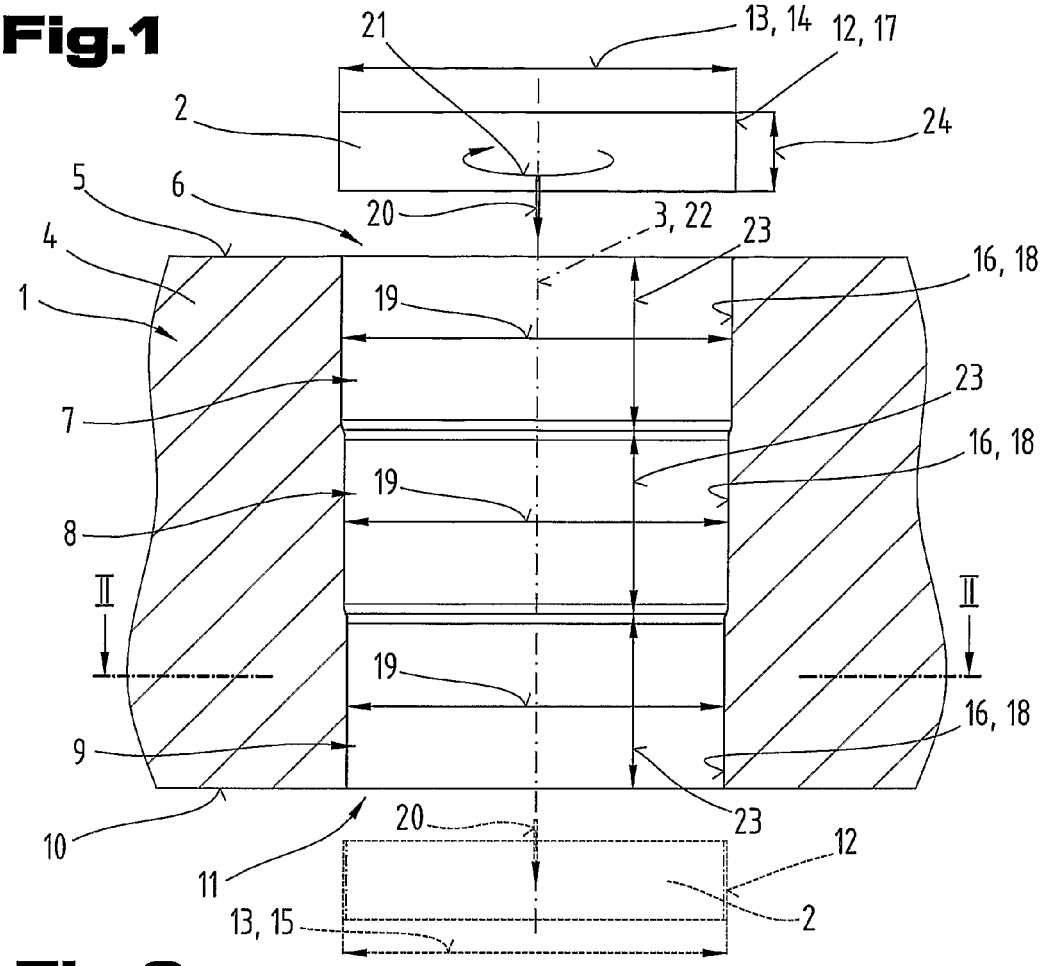

| | | | | | |
|---|---|---|---|---|---|
| 3,605,475 | A | | 9/1971 | Eakin et al. | |
| 3,705,509 | A | * | 12/1972 | Haller | 72/253.1 |
| 3,842,646 | A | * | 10/1974 | Kuhn | 72/359 |
| 3,874,207 | A | * | 4/1975 | Lemelson | 72/56 |
| 4,008,021 | A | * | 2/1977 | Fedrigo et al. | 72/430 |
| 4,111,031 | A | * | 9/1978 | Vennemeyer et al. | 72/359 |
| 4,712,411 | A | * | 12/1987 | Goodwin | 72/344 |
| 4,924,690 | A | * | 5/1990 | Kanamaru et al. | 72/343 |
| 5,659,955 | A | * | 8/1997 | Plamper | 29/893.32 |
| 5,996,229 | A | | 12/1999 | Yang | |
| 5,996,393 | A | | 12/1999 | Buttleman et al. | |
| 6,168,754 | B1 | | 1/2001 | Woolf et al. | |
| 2004/0197219 | A1 | | 10/2004 | Degen et al. | |

FOREIGN PATENT DOCUMENTS

| | | |
|---|---|---|
| RU | 2156179 | 9/2000 |
| WO | 2005099938 A1 | 10/2005 |

* cited by examiner

METHOD OF COMPACTING THE SURFACE OF A SINTERED PART

CROSS REFERENCE TO RELATED APPLICATIONS

The present application is a national phase entry under 35 U.S.C. §371 of International Application No. PCT/AT2007/000416, filed 31 Aug. 2007, published in English, which claims the benefit of Austrian Patent Application No. A 1468/2006, filed 4 Sep. 2006. The disclosures of said applications are incorporated by reference herein.

The invention relates to a method of compacting the surface of sintered parts based on the characterising features defined in claim 1 and, for implementing the method, a die having the characterising features defined in claim 15 and a punch having the characterising features defined in claim 37.

Sintered parts, in other words workpieces made from compressed and sintered metal powder, have long been used as an alternative to cast or solid workpieces which are then machined. However, the porosity of sintered parts, which may be more or less pronounced depending on the manufacturing process, has a negative effect on bending resistance and resistance to wear, which restricts the use of gears made by powder metallurgy in transmission systems that are subjected to high loads, for example.

A known approach to reducing the detrimental effects of the porosity of sintered parts is to compact the surface of sintered part preforms in a subsequent pressing operation. A method using a die for this purpose is disclosed in patent specification U.S. Pat. No. 6,168,754 B1. In the case of this method, a sintered preform, in other words a part made from powder metal which is compressed and then sintered, is compacted at its external surface by compressing it with a multistage die. The die comprises several die plates with die orifices spaced axially apart from one another, essentially corresponding to the shape of the sintered preform, but the internal diameter of which decreases in stages and is smaller than the external diameter of the sintered preform. As the sintered part is pushed through the die from the biggest to the smallest orifice, the external circumference of the sintered part is plastically and elastically deformed, causing the surface to compact and imparting the final dimensions to the sintered part. The distances between the die plates enable the sintered part to be relieved of some of the elastic deformation after each die plate. Due to this sequence of die plates and gaps, the sintered part relaxes after every die plate, as a result of which residual internal pressure stresses remaining in the sintered part are reduced in stages.

These internal pressure stresses increase resistance to bending in zones that are subjected to tensile stress and simultaneously improve the resistance of the surface compacted in this manner to wear. The disadvantage of the method and the die described in the US-B1 patent, however, is the fact that the die is less stable and resistant to wear due to the gaps between the individual die plates, as a result of which the shaping forces which the die is able to withstand are severely limited and the surface compaction which can be achieved is still inadequate for some applications.

The objective of the invention is to propose a method of compacting the surface of a sintered part which offers the possibility of obtaining a high degree of compaction of a sintered part surface whilst using a simple design of die at the same time.

This objective is achieved by a method of compacting the surface of sintered parts based on the characterising features defined in independent claim 1 and by a die and a punch incorporating the characterising features of claims 15 and 37. Due to the fact that the die portions continuously merge into one another and an internal diameter on the internal contour from the first die portion to the last die portion as measured between co-operating pressing surface parts decreases monotonously, the movement of a sintered part is assisted in the pressing direction as far as the last die portion of every die portion by the subsequent one, thereby largely preventing any deformation of the die. As a result of this robust design of the die, the internal diameter can be reduced overall to a greater degree, which significantly improves the surface compaction of the sintered part. A surprising effect of this design is that the surfaces of the sintered parts can be compacted without the negative effects of high shaping forces, such as the occurrence of seizing for example, even without the intermediate relaxation which takes place between consecutive die portions in the method known from the prior art.

It is not necessary to compact the surface around the entire external circumference of a sintered part and instead, this can be restricted to part-portions of the external surface. In order to implement the method, it is merely necessary for the pressing surfaces which act on the contact surfaces of the sintered part to be disposed more or less opposite to enable the radially acting forces to be compensated. The expression internal diameter as used in this application should not be interpreted as being limited to the diameter of a cylinder but more generally as the width measured between mutually facing pressing surface parts.

In the case of a die where the last die portion ends in the interior of the die body, the sintered part must be removed from the die after moving through the first die orifice but the method can advantageously be completed by moving the sintered part through a second die orifice lying opposite the first die orifice.

The relative movement between the sintered part and die may advantageously take place in a straight line or as a screwing movement. Sintered parts with contact surfaces which are symmetrical in revolution by reference to the axis may be forced through the die both in a straight line and with a screwing movement or in a combination of the two, whereas sintered parts with contact surfaces formed by screw surfaces must be forced through the die in a screwing movement. In the case of a sintered part that is symmetrical in revolution, tensile components may be additionally transmitted to the surface of the sintered part at a tangent due to a rotating movement, as well as the sliding friction forces acting axially on the pressing surfaces of the die portions, which is conducive to the compaction process.

In order to implement the method, it may also be of advantage if the movement is effected by the sintered part and/or by the die. In the simplest case, the die is stationary and the sintered part moves from the first die portion to the last die portion, although for reasons pertaining to structure or reasons relating to the method, it may also be of advantage to move the die or to drive both the sintered part and the die. In this respect, it is possible to use the same driving methods or different driving methods for the two elements, in which case the sintered part or the die effects a uniform, slow movement, and the die or the sintered part effects an intermittent rapid movement resulting in a pulsating relative speed, which may be of advantage in situations where it is not desirable for the relative movement to be stopped and the movement from one portion to the subsequent portion has to be effected at high speed.

As it moves through the die, the sintered part may be both pushed and pulled in the axial direction, in which case strong pulling forces should not be transmitted to a sintered part of small dimensions in the axial direction due to the risk of breakage and should be restricted to sintered parts of axially larger dimensions.

An optimum way of introducing the requisite forces into the sintered part is to apply pressure axially across more or less the full surface with the sintered part disposed between two pressing elements, e.g. two punches connected to drive mechanisms. This makes it possible to move through the die and reverse direction without running the risk of the sintered part being damaged due to higher tensile stress. To this end, the sintered part may be clamped between two pressing punches, the shape of which essentially corresponds to the die shape.

In order to implement the method, it may be of advantage to change the direction of movement of the sintered part at least once before reaching the second die orifice, for example to permit a temporary release of pressure before moving into or through the last die portion if using a more sensitive sintering material.

In one advantageous variant of the method, the sintered part is removed from the die through the first orifice once it has reached the last die portion, i.e. the direction of movement is reversed on reaching the last die portion. The fact that the parts are fed out of the die at the same position as that in which the parts are fed in prior to implementing the method means that this variant is conducive to the flow of the parts.

Since the last die portion affects the finished dimension of the sintered part after implementing the method, it is of advantage if the sintered part is compressed in the last die portion to an internal diameter which is smaller than a desired size of a sintered part by the value of the elastic deformation of the sintered part caused by the pressing forces which corresponds to this internal diameter. Since the plastic deformation takes place largely at the external surface of the sintered part, the elastic element of the deformation can be estimated relatively well by a calculation method, which means that the last die portion can be designed so that the intended dimensions are imparted to the sintered part on removal from the last die portion. The dimensional accuracy achieved as a result obviates the need for subsequent processing steps to bring the finished dimension closer to a desired dimension, e.g. a grinding operation.

To make it easier to introduce the sintered part into the die, it is of practical advantage if the sintered part is introduced into an inlet portion disposed before the first die orifice, which has an inlet diameter that is bigger than a non-process dimension of the sintered part at its external surface. This inlet portion may be an additional inlet plate for example, disposed upstream of the first die portion in the pressing direction, and has an orifice which is bigger than the non-processed dimension of the sintered part at its external surface by a small functional clearance. This enables the sintered part to be positioned and guided reliably before and during the process of pressing it into the first die portion.

It is also of advantage if the sintered part is moved into a calibration portion downstream of and adjoining the last die portion, which has a calibrating diameter which corresponds to a desired diameter of the sintered part at its external surface. This being the case, the calibration portion may directly adjoin the last die portion or alternatively there may be a gap between the last die portion and the calibration portion determining the final size, thereby permitting a temporary release of pressure from the sintered part before calibration.

In one possible variant of the method, a series of sintered parts is fed through the die with or without pressure-resistant spacer elements disposed between two respective sintered parts.

Although the method is conducted more or less at room temperature in the simplest case, it may be of advantage if the sintered part is at a temperature below the melting temperature as the method is being implemented, in particular in a range of 100° C. or 200° C. below the melting temperature. The fact that the method is implemented at a temperature higher than room temperature facilitates the surface compaction operation and the resultant change in structure, the advantage of which is that it enables the surface properties of the finished sintered part to be influenced on the one hand whilst reducing the forces needed to implement the method.

The method may be applied to particular advantage in situations where the sintered part is a bearing bush, bearing shell, gear, chain wheel, sprocket wheel or cam element. The surface compaction which can be achieved by the method and the increase in resistance to bending has proved to be of particular advantage in applications requiring such a sintered part.

In terms of operating the die, it may be of advantage if the last die portion has a second die orifice opposite and adjoining the first die orifice, i.e. the sintered part can be moved through the whole die, in particular pressed through it.

In one advantageous embodiment of the die proposed by the invention, the internal diameter inside a portion runs constantly, i.e. the die portion is not tapered. If the sintered part has a contact surface that is symmetrical in revolution, the pressing surface of the die portion acting on it is a circular cylindrical surface with a generatrix parallel with the axis. Since a circular cylindrical die portion is relatively easy to manufacture, a die for circular cylindrical sintered parts can be made using simple means if all the die portions each have a constant internal diameter.

However, in order to implement the method, it may be of advantage if the internal diameter inside a die portion decreases linearly in the direction towards the second die orifice. This may be achieved on the basis of a conical or pyramid-shaped design of the pressing surfaces, and the taper is oriented in the direction of the second die orifice. Other ways of influencing the compaction process are if the internal diameter inside a die portion decreases progressively or degressively in the direction towards the second die orifice.

When implementing the method, it may also be of advantage if an axial die portion length is bigger than an axial contact surface length. This ensures that a sintered part and its contact surface is introduced completely into a die portion before a front edge of the sintered part or contact surface starts to undergo deformation in the subsequent die portion. The force needed to move the sintered part therefore remains largely constant, thereby making it relatively easy to obtain a speed of motion which remains constant in phase, e.g. by controlling the pressure of a hydraulic cylinder acting on the sintered part.

The axial die portion length of the last die portion may be less than 30% of the contact surface length of the sintered part. Using a relatively short last die portion causes a kneading effect which is restricted to a small proportion of the contact surface, which additionally enhances the effectiveness of the surface compaction. In this respect, this die portion may be of a conical design, which will enhance the kneading effect. It is of particular advantage if the sintered part is removed from the die again via the first die orifice.

Particularly in the case of sintered parts of a longer length, it is of advantage if the axial length of the die portions in total is shorter than the axial contact surface length of the sintered part. This being the case, the surface compaction takes place on only a small part of the contact surface and the effects of the axial sliding friction are less than they would be with a longer die.

When implementing the method, it has proved to be of practical advantage to use a total of between three and seven, in particular five, die portions each with a constant internal diameter. Since the increasing compaction of the peripheral layer also results in a solidification which affords greater resistance to further deformation in the same way that a solid shell would, the reduction in diameter which can be achieved is limited, in which case the split based on the above-mentioned numbers of die portions is of advantage because manufacturing costs rise with the number of die portions.

Another advantageous embodiment is one in which a series of consecutive die portions alternately has a constant internal diameter and a decreasing internal diameter. The die portions with a decreasing internal diameter may therefore serve as a stepless transition between the die portions with a constant internal diameter as it were, thereby avoiding pronounced steps between consecutive die portions.

It is also of advantage if the transition from one portion to a consecutive die portion is designed with a bevel or at least a rounded region. This largely avoids a sharp-edged design of a stepped transition and accordingly higher wear on the die.

In order to ensure that the actual diameter which can be achieved with the die is as close as possible to desired diameter, it is of advantage if the internal diameter in the last die portion has a value which corresponds to a desired size of the sintered part less the value of the elastic deformation of the sintered part caused at this internal diameter by the pressing forces. As explained above, the elastic deformation of the sintered part can be estimated to a sufficiently high degree of accuracy for this purpose so that the desired size is at least more or less imparted to the sintered part after it has passed through the last die portion.

When compacting the surface of circular cylindrical sintered parts such as bearing bushes for example, it is of advantage if the internal contour is symmetrical in revolution with respect to the axis. This enables the surface of a circular cylindrical sintered part to be compacted around its entire circumference with a single pass of the method, whereas if the pressing surfaces are only partially circular cylindrical, it will be necessary to run the pressing operation two or more times and turn the sintered part in between.

It is also of advantage if the internal contour is rotationally symmetric by reference to the axis, so that the die can also be used to compact the surface of sintered gears, sprocket wheels or chain wheels in particular. However, the method can still be used for sintered parts of an irregular shape if the pressing surface of a die portion is designed with a generally cylindrical surface. The application is therefore not restricted to sintered parts that are symmetrical in revolution or rotationally symmetric.

The pressing surface of a die portion may also be provided in the form of a spiral surface, in which case the surfaces of an obliquely toothed gear can be compacted if the movement through the die is effected with a screwing movement.

In order to compact the surface of a spur gear with straight teeth or a spur gear segment, the pressing surfaces of the die portions have at least some portions with internal straight toothing. This being the case, the tooth flanks run in the axial direction.

If the pressing surfaces of the die portions each have at least some portions with internal oblique toothing, it is also possible to compact the surface of obliquely toothed spur gears or spur gear segments.

The die may be assembled from several die parts in both the axial and the radial direction but an extremely robust design is obtained if it is of an integral design.

It is significantly easier to introduce a sintered part into the die if an inlet portion is disposed upstream of the first die portion in the direction towards the second die orifice, the internal diameter of which is bigger than a non-processed diameter of the sintered part. The inlet portion therefore corresponds to a die portion but with a clearance fit rather than a pressing fit for the sintered part.

In order to increase dimensional accuracy, a calibration portion may also be provided downstream of the last die portion in the pressing direction with a calibrating diameter which is smaller than the desired diameter of the sintered part. This being the case, the calibration portion may be provided directly adjoining the last die portion or a gap may be left in between which causes a temporary release of pressure from the sintered part so that it expands and loses at least some of its elastic deformation before the actual calibration step.

The invention will be explained in more detail below with reference to examples of embodiments illustrated in the appended drawings.

Figure 2:
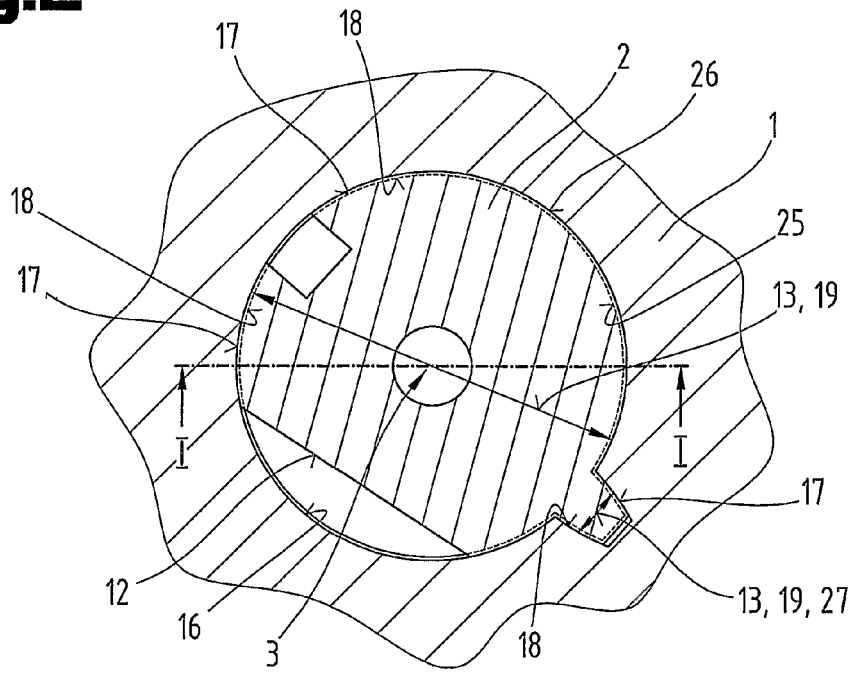
Figure 3:
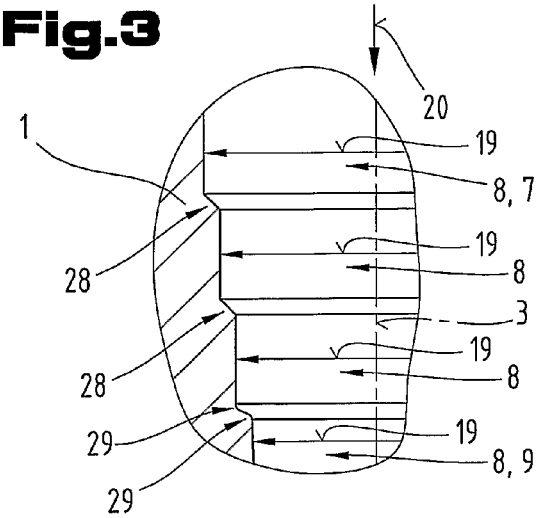
Figure 4:
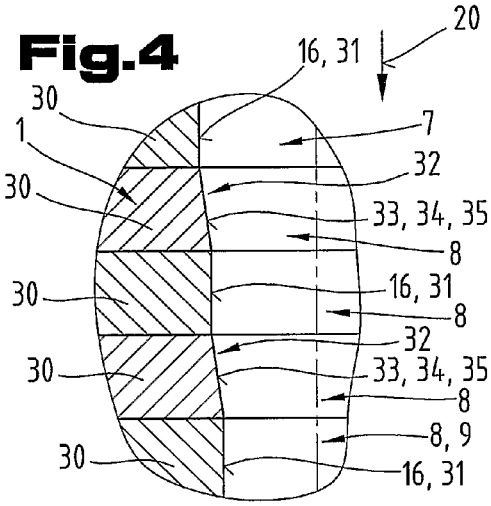
Figure 5:
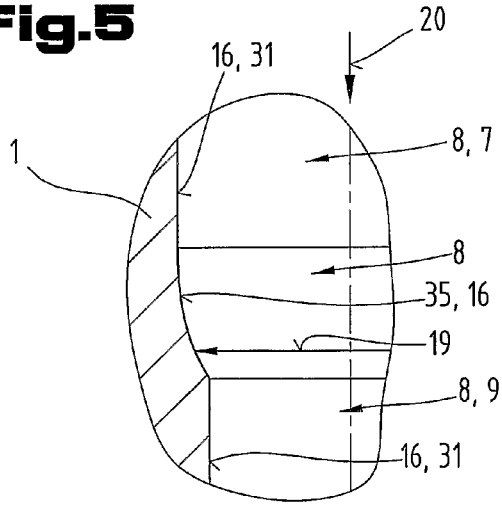
Figure 6:
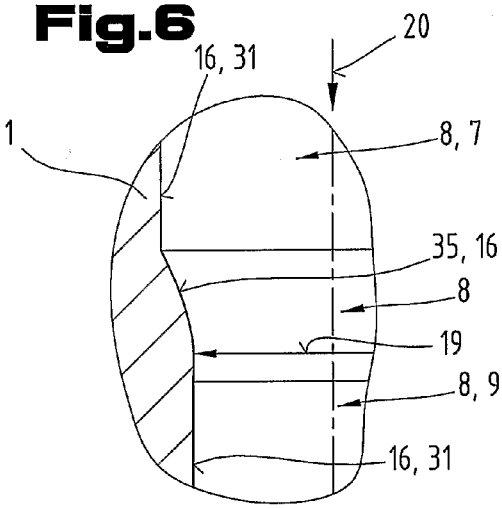
Figure 7:
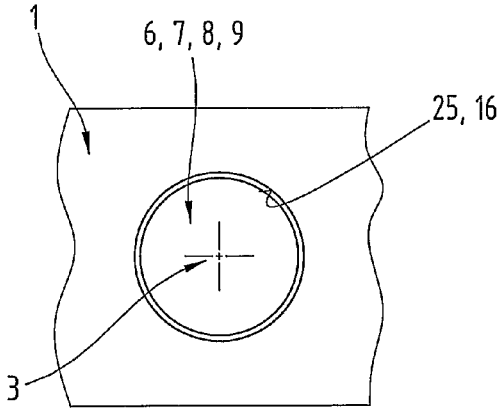
Figure 8:
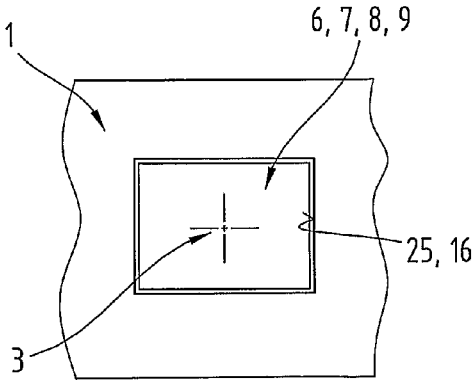
Figure 9:
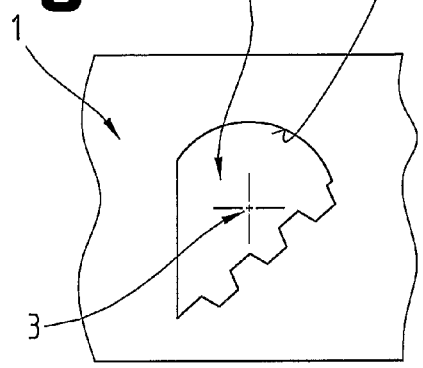
Figure 10:
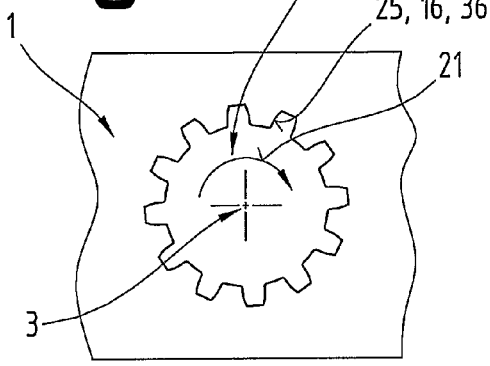
Figure 11:
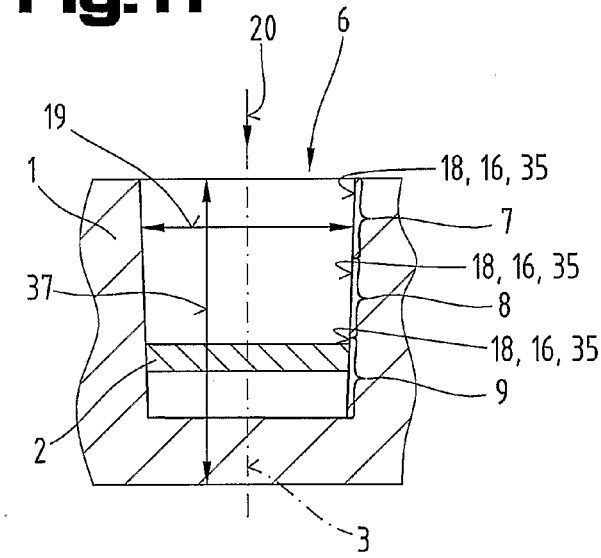
Figure 12:
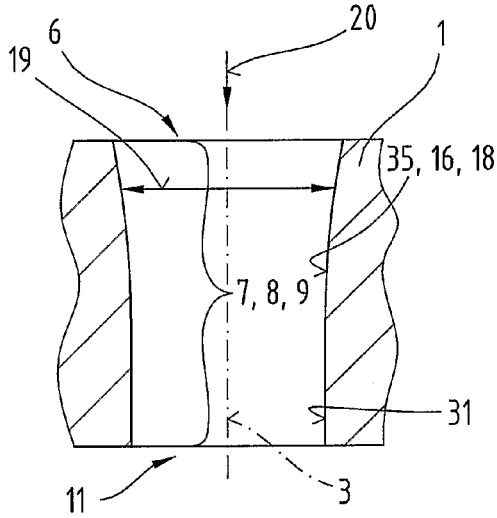
Figure 13:
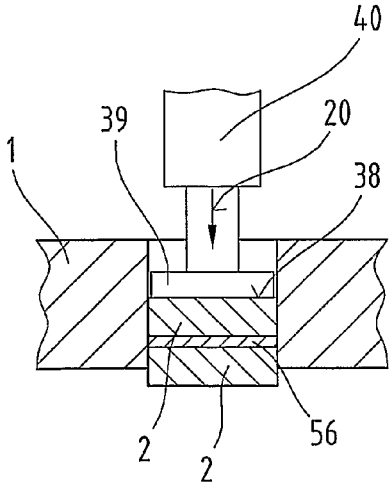
Figure 14:
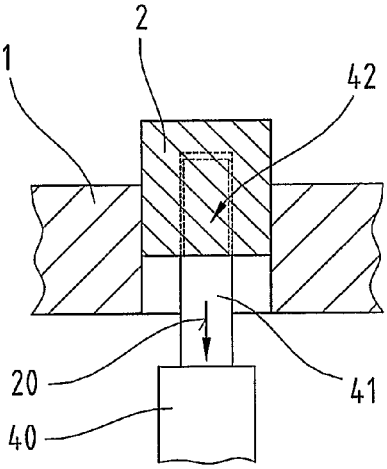
Figure 15:
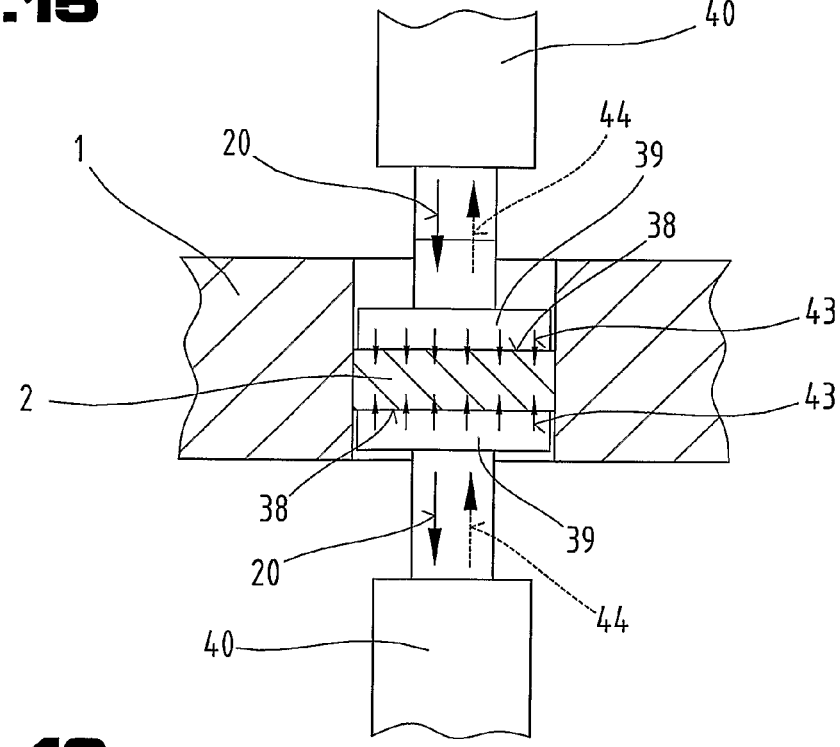
Figure 16:
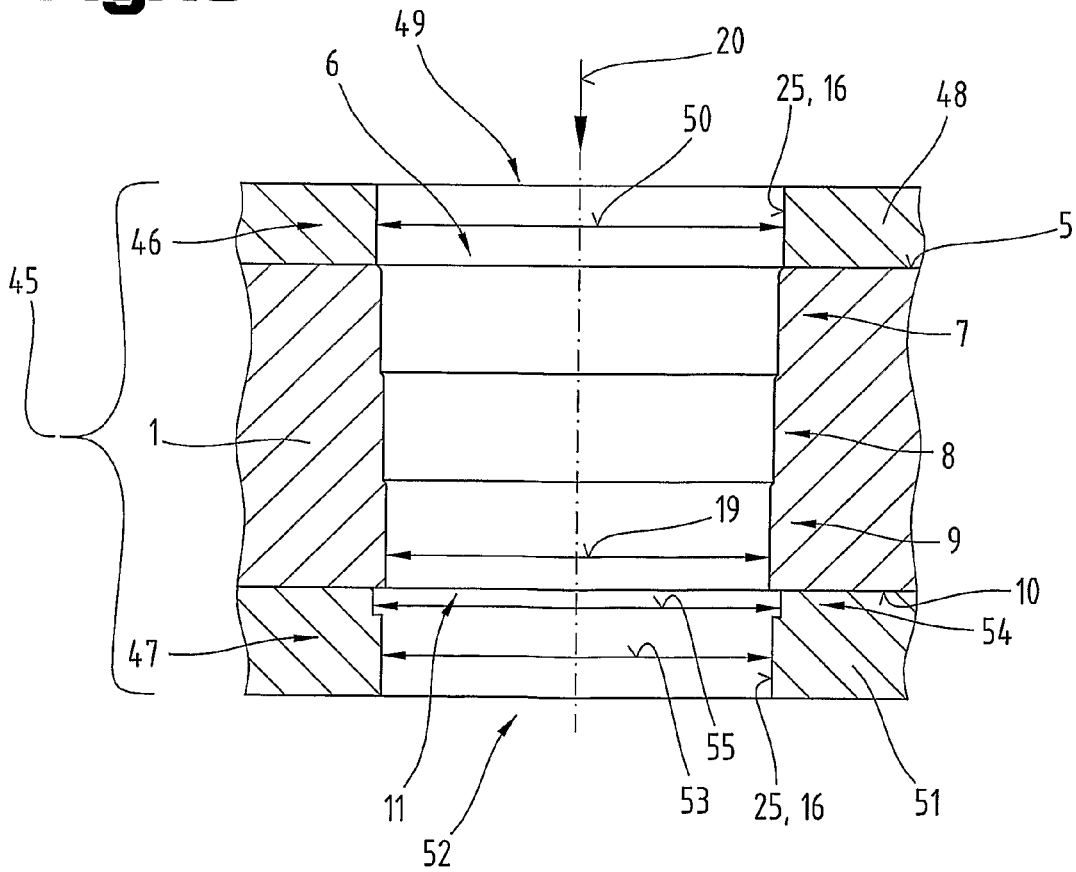

These are simplified, schematic diagrams illustrating the following:

FIG. 1 a longitudinal section along line I-I indicated in FIG. 2 through a die as proposed by the invention with a sintered part ready to be processed;

FIG. 2 a cross-section along line II-II indicated in FIG. 1 through another embodiment of a die with a sintered part processed by it;

FIG. 3 a detail from a longitudinal section illustrating another embodiment of a die;

FIG. 4 a detail from a longitudinal section illustrating another embodiment of the die;

FIG. 5 a detail from a longitudinal section illustrating another embodiment of the die;

FIG. 6 a detail from a longitudinal section illustrating another embodiment of the die;

FIG. 7 an axial plan view of another embodiment of the die;

FIG. 8 a plan view of another embodiment of the die;

FIG. 9 a plan view of another embodiment of the die;

FIG. 10 a plan view of two other embodiments of the die with straight and oblique internal toothing;

FIG. 11 a longitudinal section through another embodiment of the die;

FIG. 12 a longitudinal section through another embodiment of the die;

FIG. 13 implementation of the method with two sintered parts being pushed through the die simultaneously;

FIG. 14 the method with the sintered part being pulled through the die;

FIG. 15 implementation of the method with pressure applied to both ends of the sintered part;

FIG. 16 another embodiment of a die with an additional inlet portion and an additional calibration portion.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 shows a longitudinal section through a die 1 proposed by the invention for compacting the surface of a sintered part 2 by moving it through the die 1 along an axis 3. It comprises a die main body 4 with a first die orifice 6 on a die surface 5, from which several die portions 7, 8 and 9 run along the axis 3 into the interior of the die main body 4. The first die orifice 6 is adjoined by a first die portion 7 and a last die portion 9 extends as far as an oppositely lying second die surface 10 in the embodiment illustrated, and thus forms a second die orifice 11. As an alternative to the embodiment illustrated, the last die portion 9 may also terminate in the interior of the die main body 4, in which case there is no second die orifice 11. This being the case, the sintered part 2 has to be removed from the die 1 through the first die orifice 6 again in any event.

The sintered part 2 is made from metal powder which is pressed and then sintered, and since the method and materials for producing such a sintered preform are sufficiently well known from the prior art, they will not be explained here.

In the embodiment illustrated as an example, the sintered part 2 is of a disc-shaped design and has a diameter 13 at an external surface 12 which corresponds to a non-processed diameter 14 before surface compaction and to a smaller final diameter 15 after the surface compaction.

The surface of the sintered part 2 is compacted by introducing it through the first die orifice 6 into the first die portion 7 and then moving it through all the other die portions 8 and also to the last die portion 9 and, in each die portion 7, 8, 9, the external surface 12 of the sintered part 2 is pressed in at least some portions of the external surface 12 against wall surfaces 16 of the die portions 7, 8, 9. Accordingly, one or more contact surfaces 17 on the external surface 12 of the sintered part 2 are in a pressing contact with one or more pressing surfaces 18 on the wall surfaces 16 of the die portions 7, 8, 9. The contact surface 17 may also be a part of the external surface 12 or the entire external surface 12; the pressing surface 18 may be a part-portion of the wall surface 16 or the entire wall surface 16, and the part-portion may be one disposed in the axial extension and/or the extension in the circumferential direction.

The pressing action is achieved due to the fact that an internal diameter 19 defined by the internal width between oppositely lying and co-operating portions of the pressing surface 18 of a die portion 7, 8, 9 is respectively smaller than the non-processed diameter 14 of the sintered part 2. The expression internal diameter 19 should not be interpreted as meaning that it is restricted to circular cross-sections and instead, it is also intended to mean the internal width between co-operating pressing surface parts which need not necessarily extend round the axis 3 of the die 1. Similarly, the diameter 13 on the sintered part 2 should not be interpreted as referring to only radial directions.

The consecutive die portions 7, 8, 9 disposed along the axis 3 merge continuously into one another and have a monotonously decreasing internal diameter 9 from the first die portion 7 to the last die portion 9, i.e. the next internal diameter 19 may be of the same size or decrease but does not become bigger. Accordingly, the pressing action on the contact surface 17 of the sintered part 2 increases from the first die portion 7 to the last die portion 9, thereby defining a pressing direction 20 pointing from the first die portion 7 to the last die portion 9. In the simplest situation, therefore, the sintered part 2 moves through the die 1 in a straight line in the pressing direction 20 from the first die orifice 6 to the last die portion 9, after which the sintered part 2 is removed from the die 1 via the second die orifice 11 or through the first die orifice 6 after reversing the direction of movement so that it is opposite the pressing direction 20.

The straight movement in the direction of the axis 3 may also be combined with a superimposed rotating movement, for example in a direction of rotation 21, as a result of which the sintered part 2 effects a screwing movement in the die 1. Due to this type of movement, it is also possible to compact the surface of sintered parts 2 with an external surface 12 which also incorporates screw surfaces with the die 1. In this instance, the sintered part 2 moves about a screw axis 22 which coincides with the axis 3 or extends parallel with it, for example if the screw surface to be compacted on the external surface 12 of the sintered part 2 does not extend around the entire circumference of the sintered part 2 and does not have a main body that is symmetrical in revolution.

The direction of movement of the sintered part 2 in the die 1 as well as the speed of the movement may be plotted in any manner with a view to optimising the surface compaction and may also include a reversal in the direction of movement, a stoppage, very slow and also very rapid movements. Pressure stresses occur due to the pressing contact acting between the contact surfaces 17 and the pressing surfaces 18, oriented essentially perpendicular to the contact surfaces 17, and because of the movement of the sintered part, the contact surface 17 is additionally subjected to a sliding friction tension in the axial direction during a straight movement or in both the axial and tangential direction in the case of a screwing movement. These tensions in the sintered part 2 acting on the contact surfaces 17 cause both an elastic and a plastic deformation of the sintered part 2, and it is the plastic element which causes the permanent surface compaction. During this surface compaction, the powder metal particles joined to one another at so-called bridges due to the pressing and then sintering operation are forced firmly against one another and plastically deformed. The pore-like cavities which exist between the powder metal particles after sintering are therefore reduced in terms of their volume and the material density is increased in this region.

The effect of the surface compaction is highest directly at the contact surface 17 due to the additional sliding friction tension and decreases in the direction towards the interior of the sintered part 2. Using the method, typical peripheral layers of sintered parts 2 can be compacted with a thickness of a few hundredths of a millimeter to several tenths of a millimeter and more. After this surface compaction, internal pressure stresses remain in the sintered part 2 in its peripheral layers, which advantageously increase resistance to bending and increase resistance to wear.

Other factors which affect the method are the axial length of the sintered part 2 and the length of its contact surfaces 17 as well as the axial length of the die portions 7, 8, 9. In FIG. 1, all the die portions 7, 8, 9 are approximately the same size as the portion lengths 23, which are bigger than a contact surface length 24 of the sintered part 2. Alternatively, individual ones or several of the die portion lengths 23, in particular the die portion length 23 of the last die portion 9, may be shorter than the contact surface length 24 of the sintered part 2. It is even possible for the contact surface length 24 to be bigger than the sum of all the die portions 7, 8, 9.

The relative movement between the sintered part 2 and the die 1 needed to run the method may be a movement of the sintered part 2 and/or a movement of the die 1, and to this end the sintered part 2 and the die 1 are respectively connected to a separate drive or a stationary frame.

Once the method of compacting the surface has ended, the sintered part 2 leaves the last die portion 9 either through the second die orifice 11 or through the first die orifice 6 after reversing the direction of movement so that it is in the direction opposite the pressing direction 20. The elastic deformations which occur in the sintered part 2 as it is pressed in can then ease to a certain extent and the diameter 13 of the sintered part 2 is increased slightly by the internal diameter 19 of the last die portion 9 due to elastic rebound to assume the bigger, final diameter 15 which corresponds as far as possible to the desired diameter of the sintered part 2. FIG. 1 illustrates the sintered part 2 with broken lines, disposed after the last die portion 9 in the pressing direction 20 and its final diameter 15 is slightly bigger than the internal diameter 19 of the last die portion 9.

FIG. 2 illustrates a cross-section along line II-II indicated in FIG. 1 through the die 1 proposed by the invention with a sintered part 2 pressed into it. In the embodiment illustrated as an example, it is not symmetrical in revolution by reference to the axis 3 and its contact surface 17 at which the surface compaction takes place does not extend around its entire external circumference, i.e. only a part of its external surface 12 is compacted. Not all the wall surface 16 on the die 1 is involved in the compaction and instead it is only the pressing surfaces 18 which make contact with the corresponding contact surfaces 17 of the sintered part 2. As may be seen, in the most general situation, the surface is compacted only where an internal contour 25 of a die portion 7, 8, 9 defined by the wall surface 16 co-operates with an external contour 26 defined by the external surface 12 of the sintered part 2. A contact surface 17 on the sintered part 2 may be compacted in all of the die portions 7, 8, 9 by a corresponding pressing surface 18, although as an alternative it is also possible that only individual contact surfaces 7 or parts of them are compacted in individual or several die portions 7, 8 and/or 9, in which case the pressing surfaces 18 in individual or several die portions 7, 8, 9 are of a smaller design.

As may be seen from FIG. 2, it is not just the diameter 13 which also extends through the axis 3 which is taken into account but also the diameter 13 corresponding to a tooth thickness 27 on external toothing of the sintered part 2. Again in this case, oppositely lying contact surfaces 17 of the sintered part 2 are pressed between oppositely lying pressing surfaces 18 of a die portion 7, 8, 9 due to the monotonously decreasing internal diameter 19.

FIG. 3 shows a detail from a longitudinal section through another embodiment of the die 1 proposed by the invention with four die portions 7, 8, 9, the internal diameter 19 of which becomes smaller in stages in the pressing direction 20. The transition from one die portion 7, 8 to the adjoining die portion 8, 9 may be designed in the form of a bevel 28 or may be provided with a rounded region 29, in which case a concave rounded region may be adjoined by a convex rounded region in the pressing direction 20. This results in a soft transition of the sintered part 2 from one die portion 7, 8 to the subsequent die portion 8, 9 without material unintentionally being removed from the sintered part 2 due to a sharp-edged step or without the edges breaking open at the transition points of the die 1.

FIG. 4 illustrates a detail from a longitudinal section through another embodiment of the die 1 proposed by the invention, which in this embodiment is not integral but is made up of several die plates 30. By contrast with the embodiment illustrated in FIG. 3 where the internal diameter 19 inside the die portions 7, 8, 9 is always constant, in other words formed by a circular cylindrical surface 31, the die 1 illustrated in FIG. 4 also has a die portion 8 respectively between two die portions 7 and 8, 8 and 8, or 8 and 9 with circular cylindrical surfaces 31, which has a cross-sectional taper 32 in the pressing direction 20. Due to such a sequence of circular cylindrical surface 31 and cross-sectional tapers 32, formed by a conical surface 33, a pyramid surface 34 or any other tapering surface 35, the pressure stresses at the contact surfaces 17 of the sintered part 2 are able to ease more slowly and more gently because of the slow decrease in the internal diameter 19 by reference to the axial length.

FIG. 5 illustrates a detail from a longitudinal section through another embodiment of the die 1. In this case, a die portion 8 disposed between two other die portions 7 and 8, or 8 and 8, or 8 and 9 with circular cylindrical surfaces 31 has a tapering surface 35 which has a progressive contour in the pressing direction 20, i.e. the decrease in the internal diameter 19 inside the portion 8 becomes more pronounced or increases in the pressing direction 20. The decrease in the internal diameter 19 is progressive in the region of the tapering surface 35.

FIG. 6 shows a detail from a longitudinal section through another embodiment of the die 1, where a die portion 8 with a tapering surface 35 as a wall surface 16 is disposed between two die portions 7 and 8, or 8 and 8, or 8 and 9 with a circular cylindrical surface 31 as a wall surface 16, and the decrease in the internal diameter 19 becomes less pronounced in the pressing direction, in other words follows a degressive contour.

FIG. 7 illustrates a plan view of another embodiment of the die 1 proposed by the invention, where the internal contour 25 of the wall surface 16 is symmetrical in revolution by reference to the axis 3.

FIG. 8 shows a plan view of another embodiment of the die 1 proposed by the invention, where the internal contour 25 of the wall surface 16 of the die portions 7, 8, 9 is of a rectangular design. The internal contour 25 is therefore only rotationally symmetric by reference to the axis 3 and is suitable for compacting sintered parts with a rectangular cross-section.

FIG. 9 shows a plan view of another embodiment of the die 1 with an internal contour 25 of the wall surfaces 16 of the die portions 7, 8, 9 incorporating a circle segment, a straight section and toothing. The method of compacting the surface of sintered parts 2 is therefore not restricted to sintered parts 2 with external contours 26 that are symmetrical in revolution or rotationally symmetrical by reference to the axis but can be used for external contours 26 of any shape.

FIG. 10 shows a plan view of another embodiment of the die 1, where the internal contour 25 of the wall surfaces 16 of the die portions 7, 8, 9 forms internal toothing 36 by means of which the external surfaces 12 of a gear can be compacted.

The internal contour 25 may run in a straight line in the direction of the axis 3, in which case the die 1 is suitable for compacting the surfaces of gears with straight teeth, but if the internal contour 25 in the die interior is not straight but extends into the die interior with an additional screwing movement in the direction of rotation 21, gears with oblique toothing can be subjected to a surface compaction by the die 1. Similarly, the wall surfaces 16 of internal contours 25 of the wall surfaces 16 based on the embodiments illustrated as examples in FIG. 8 and FIG. 9 may also follow a screwing movement and the wall surfaces 16 of the die 1 shaped as screw surfaces together with contact surfaces 17 in the form of co-operating screw surfaces can compact a screw-shaped sintered part 2 as it is turned.

FIG. 11 shows a longitudinal section through another embodiment of the die 1 which has only a first die orifice 6, as a result of which a sintered part 2 has to be removed from the die 1 again via the first die orifice 6 on reaching the last die portion 9. The pressing surfaces 18 of the individual die portions 7 in this embodiment merge steplessly into one another with a linearly decreasing internal diameter 19. The individual die portions 7 therefore fuse to a certain extent to a single large die portion. This embodiment of the die 1 may also be used to influence the final diameter 15 of the sintered part 2 because the sintered part 2 is introduced into the die 1 to a differing insertion depth 37. This embodiment of the die 1 can be used in particular to compact the surface of sintered parts 2 where keeping to a specific final diameter 15 is not a primary concern but the extent of the surface compaction is important. If a constant maximum force is always applied in order to move the sintered part 2 in the pressing direction 20 for example, more or less the same surface compaction is achieved even if the sintered parts 2 have fluctuating non-processed diameters 14.

FIG. 12 shows a longitudinal section through another embodiment of the die 1, where the individual die portions 7, 8, 9 are also fused to form a single die portion. Its wall surface 16 or the pressing surface 18 is therefore formed by a generally tapering surface 35, the internal diameter 19 of which decreases degressively in the pressing direction 20 and ends with a circular cylindrical surface 31 in the region of the second die orifice 11.

FIG. 13 illustrates how the method proposed by the invention is implemented when two sintered parts 2 are pushed through the die 1 in the pressing direction 20 with the aid of a pressing element 39 pushing against an end face 38 of a sintered part 2, e.g. a pressing punch. A pressure-resistant spacer element 56 is disposed between the two sintered parts 2. The pressing element 39 is connected to an appropriate drive system 40 for this purpose, for example a hydraulic press, a pneumatic press, a mechanical press, etc.

FIG. 14 illustrates how the method is implemented when a sintered part 2 is pulled through the die 1 in the pressing direction 20. A pulling element 41 is secured in the sintered part 2 by means of an appropriate anchor 42 for this purpose, e.g. by screwing the pulling element 41 in, which in turn is connected to an appropriate drive system 40.

Implementing the method based on pushing the sintered part 2 through the die 1 is particularly recommended for sintered parts 2 with a small axial length compared with the diameter 13, in particular the contact surface length 24, whereas the variant of the method based on pulling the sintered part 2 through the die 1 can be used for sintered parts 2 with an axial length that is bigger than the diameter 13 of its cross-section.

FIG. 15 illustrates another variant of the method of surface compaction where the sintered part 2 is subjected to pressure during the entire compaction process from its two oppositely lying end faces 38 between two pressing elements 39 by means of pressing forces 43—indicated by small arrows—and is so both when moving in the pressing direction 20 and when moving in an opposite direction 44—indicated by an arrow in broken lines. With this variant of the method, it is possible to reverse the direction of movement even when processing disc-shaped sintered parts 2 with a short axial length, for example to enable a temporary release of pressure and reduce elastic deformation.

FIG. 16 shows a die 45, which comprises a die 1 proposed by the invention, an additional inlet portion 46 disposed upstream of the first die orifice 6 of the die 1 as viewed in the pressing direction 20, and an additional calibration portion 47 disposed downstream of the second die orifice 11 of the die 1 in the pressing direction 20.

The inlet portion 46 is provided in the form of an inlet plate 48, which directly adjoins the first die surface 5 of the die 1. The inlet orifice 49 in the inlet plate 48 is disposed coaxially with the die, the wall surface 16 of which has the same internal contour 25 as the die portions 7, 8, 9 but an inlet diameter 50 which is bigger than the non-processed diameter 14 of the sintered part 2. The inlet portion 46 therefore makes it easier to introduce the sintered part 2 into the first die portion 7 of the die 1 accurately and in the correct position.

The calibration portion 47 comprises a calibration plate 51 lying against the second, oppositely lying die surface 10, which has a calibration orifice 52 coaxial with the die 1, the wall surface 16 of which has the same internal contour 25 as the die 1 but a calibrating diameter 53 which corresponds to the desired diameter of the sintered part 2 or is smaller than it. After the last die portion, the diameter 19 of which is smaller than the desired diameter of the finished sintered part 2, it can expand in the calibration portion 47 to the calibrating diameter 53, in other words the desired diameter, as a result of which the final diameter 15 at least more or less corresponds to the desired diameter. In addition, the second die orifice 11 may be directly adjoined by a pressure-relieving portion 54, which has a pressure-relieving diameter 55 which is bigger than the desired diameter or final diameter 15 of the sintered part 2. As a result, the latter can be relieved of most of its elastic deformation in the pressure-relieving portion 54, thereby increasing the accuracy of the subsequent calibration process. Since the calibrating diameter is smaller, an additional kneading effect is achieved. As a result of the calibration, it is possible to compensate for any axial tapering which might occur due to the compaction process.

In the direction of the axis 3, the calibration stage may be longer than the height of the sintered part in this direction. The calibration stage may also have a larger diameter than the last die portion 9 so that a kneading effect is also obtained as the sintered part 2 is ejected via the first die orifice 6.

The invention is naturally also suitable for compacting the surface of orifices, such as bores in sintered parts 2. Instead of the die 1, a punch is used which, like the die 1, also has portions of differing diameter, but in this case the diameter of the mutually merging portions increases monotonously. All the other explanations relating to the die apply to the punch, and the details relating to "internal" and "external" need to be changed accordingly. All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

The embodiments illustrated as examples represent possible variants of the method proposed by the invention and the die, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the die, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2; 3; 4; 5; 6; 7; 8; 9; 10; 11; 12; 13;

14; 15; 16 constitute independent solutions proposed by the invention in their own right. The objectives and associated solutions proposed by the invention may be found in the detailed descriptions of these drawings.

List of Reference Numbers

1 Die
2 Sintered part
3 Axis
4 Die main body
5 Die surface
6 Die orifice
7 Die portion
8 Die portion
9 Die portion
10 Die surface
11 Die portion
12 External surface
13 Diameter
14 Non-processed diameter
15 Final diameter
16 Wall surface
17 Contact surface
18 Pressing surface
19 Internal diameter
20 Pressing direction
21 Direction of rotation
22 Screw axis
23 Die portion
24 Contact surface length
25 Internal contour
26 External contour
27 Tooth thickness
28 Bevel
29 Rounded region
30 Die plate
31 Circular cylindrical surface
32 Cross-sectional taper
33 Conical surface
34 Pyramid surface
35 Tapering surface
36 Internal toothing
37 Insertion depth
38 End face
39 Pressing element
40 Drive system
41 Pulling element
42 Anchor
43 Pressing force
44 Opposite direction
45 Die
46 Inlet portion
47 Calibration portion
48 Inlet plate
49 Inlet orifice
50 Inlet diameter
51 Calibration plate
52 Calibration orifice
53 Calibrating diameter
54 Pressure-relieving portion
55 Pressure-relieving diameter
56 Spacer element

The invention claimed is:

1. A method of compacting the surface of a sintered part comprising:

moving a sintered part in a die along an axis in a pressing direction through a plurality of die portions from a first die portion at a first die orifice into a last die portion, wherein a wall surface of each of the plurality of die portions forms at least one pressing surface against which a contact surface formed by an external surface of the sintered part is pressed, and an internal contour lying in a cross-section with respect to the axis and defined by the pressing surface corresponds at least approximately to an external contour defined by the contact surface; and as the sintered part is moved from the first die orifice to the last die portion, a surface compaction takes place due to die portions which merge continuously into one another and due to monotonously decreasing internal diameters of the die portions as measured between a plurality of co-operating pressing surfaces, wherein the sintered part is removed from the die through a second die orifice lying opposite the first die orifice.

2. The method as claimed in claim 1, wherein the movement is effected in a straight line or is a screwing movement.

3. The method as claimed in claim 1, wherein the movement is effected by the sintered part and/or by the die.

4. The method as claimed in claim 3, wherein the sintered part is pushed or pulled through the die from one or both end faces.

5. The method as claimed in claim 4, wherein pressure is applied axially to the sintered part substantially across the full surface between two pressing elements during the movement through the die.

6. The method as claimed in claim 5, wherein the direction of movement of the sintered part is changed at least once before reaching the last die portion.

7. The method as claimed in claim 1, wherein the sintered part is compressed in the last die portion to an internal diameter which reduces a desired size of the sintered part by the value which corresponds to the elastic deformation of the sintered part at this internal diameter caused by the pressing forces.

8. The method as claimed in claim 1, wherein the sintered part is introduced into an inlet portion disposed upstream of the first die orifice with an inlet diameter which is bigger than a non-processed diameter of the sintered part at its external surface.

9. The method as claimed in claim 1, wherein, downstream of the second die orifice, the sintered part is moved into a calibration portion adjoining the latter, which has a calibrating diameter corresponding to a desired dimension of the sintered part at its external surface.

10. The method as claimed in claim 1, wherein a plurality of sintered parts are moved through the die simultaneously with or without spacer elements disposed respectively between two sintered parts.

11. The method as claimed in claim 1, wherein, whilst implementing the method, the sintered part is at a temperature between about 100° C. to 200° C. below the sintering temperature.

12. The method as claimed in claim 1, wherein the sintered part is a bearing bush, bearing shell, gear, chain wheel, sprocket wheel or cam element.

13. A die for compacting a surface of a sintered part comprising:

a plurality of die portions disposed one after the other along an axis in a pressing direction, the plurality of die portions comprising a first die portion at a first die orifice and a last die portion; and at least one pressing surface disposed in a cross-section with respect to the axis on a wall surface of each of the plurality of die portions defines an internal contour which at least approximately corresponds to an external contour defined by a contact surface disposed on an external surface of the sintered part, wherein the plurality of die portions continuously merge into one another and an internal diameter at the internal contour as measured between a plurality of co-operating portions of pressing surfaces decreases monotonously from the first die portion to the last die portion, wherein the plurality of die portions have a constant internal diameter and a decreasing internal diameter in an alternating arrangement.

14. The die as claimed in claim 13, wherein the last die portion is adjoined by a second die orifice lying opposite the first die orifice.

15. The die as claimed in claim 13, wherein the internal diameter inside at least one of the die portions is constant in the pressing direction.

16. The die as claimed in claim 13, wherein the internal diameter inside the die portion decreases linearly in the pressing direction.

17. The die as claimed in claim 13, wherein the internal diameter inside the die portions decreases progressively in the pressing direction.

18. The die as claimed in claim 13, wherein the internal diameter inside the die portions decreases degressively in the pressing direction.

19. The die as claimed in claim 13, wherein an axial die portion length of at least one of the die portions is bigger than an axial contact surface length of the sintered part.

20. The die as claimed in claim 14, wherein the axial die portion length of the last die portion is less than 30% of the axial contact surface length of the sintered part.

21. The die as claimed in claim 14, wherein the axial length of all the die portions in total is shorter than the axial contact surface length of the sintered part.

22. The die as claimed in claim 13, wherein the die has between three and seven die portions each with a constant internal diameter decreasing in stages.

23. The die as claimed in claim 13, wherein the transition from one die portion to a subsequent die portion is formed by a bevel or a rounded region.

24. The die as claimed in claim 13, wherein the internal diameter in the last die portion has a value which reduces a desired size of the sintered part by the value corresponding to the elastic deformation of the sintered part at this internal diameter caused by the pressing forces.

25. The die as claimed in claim 13, wherein the internal contour is symmetrical in revolution by reference to the axis.

26. The die as claimed in claim 13, wherein the internal contour is rotationally symmetric by reference to the axis.

27. The die as claimed in claim 13, wherein the pressing surface of at least one of the die portions is formed by a generally cylindrical surface.

28. The die as claimed in claim 13, wherein the pressing surface of at least one of the die portions is formed by a screw surface.

29. The die as claimed in claim 13, wherein the pressing surfaces of the die portions are respectively formed, at least in some sections, by internal straight toothing.

30. The die as claimed in claim 13, wherein the pressing surfaces of the die portions are respectively formed, at least in some sections by internal oblique toothing.

31. The die as claimed in claim 13, wherein the die portions are integrally joined to one another.

32. The die as claimed in claim 13, wherein an inlet portion with an inlet diameter that is bigger than a non-processed diameter of the sintered part is disposed in upstream of the first die portion in the pressing direction.

33. The die as claimed in claim 14, wherein a calibration portion is disposed downstream of and adjoining the last die portion in the pressing direction, which has a calibrating diameter which corresponds to the desired dimension of the sintered part.

34. A punch for compacting the surface of sintered parts comprising:

plurality of punch portions disposed one after the other along an axis in a pressing direction, and at least one pressing surface on a wall surface of each of the plurality of punch portions disposed in a cross-section with respect to the axis defines an external contour which at least approximately corresponds to an internal contour defined by a contact surface disposed on an internal surface of the sintered part, wherein the punch portions continuously merge into one another and an external diameter on the external contour as measured between co-operating portions of pressing surfaces increases monotonously from the first punch portion to the last punch portion in the pressing direction, wherein the die portions have a constant internal diameter and a decreasing internal diameter in an alternating arrangement.

* * * * *